US006887010B2

(12) United States Patent
Mayer Rodis

(10) Patent No.: US 6,887,010 B2
(45) Date of Patent: May 3, 2005

(54) DECORATIVE BENCH BARRIER

(76) Inventor: Nancy J. Mayer Rodis, 2803 Green Shade Ct., Ellicott City, MD (US) 21042

( * ) Notice: Subject to any disclaimer, the term of this patent is extended or adjusted under 35 U.S.C. 154(b) by 0 days.

(21) Appl. No.: 10/426,631

(22) Filed: May 1, 2003

(65) Prior Publication Data

US 2003/0206769 A1 Nov. 6, 2003

Related U.S. Application Data

(60) Provisional application No. 60/377,262, filed on May 1, 2002.

(51) Int. Cl.[7] ..... E01F 15/00
(52) U.S. Cl. ..... 404/6
(58) Field of Search ..... 404/6–9; 256/13.1; 290/440.13, 243, 244, 470; D6/4, 6, 37, 634

(56) References Cited

U.S. PATENT DOCUMENTS

| | | | | | |
|---|---|---|---|---|---|
| 1,886,988 | A | * | 11/1932 | Hilarius | 108/159 |
| 1,952,949 | A | * | 3/1934 | Spang | 297/158.2 |
| 2,659,422 | A | * | 11/1953 | Holland | 297/447.1 |
| 3,230,007 | A | * | 1/1966 | Spangler et al. | 297/244 |
| 3,756,657 | A | * | 9/1973 | Johnson | 297/440.1 |
| D235,908 | S | * | 7/1975 | Rosenwach | D11/144 |
| D244,888 | S | * | 7/1977 | Shafer et al. | D6/335 |
| 4,769,191 | A | * | 9/1988 | Diana | 264/69 |
| 4,986,042 | A | * | 1/1991 | Richardt | 52/102 |
| 5,134,815 | A | * | 8/1992 | Pickett | 52/71 |
| 5,391,226 | A | * | 2/1995 | Frankowski | 106/696 |
| 5,428,926 | A | * | 7/1995 | Melfi | 52/71 |
| D362,348 | S | * | 9/1995 | Sacchi Lodispoto | D6/336 |
| D418,326 | S | * | 1/2000 | Sexton et al. | D6/381 |
| D460,283 | S | * | 7/2002 | Floyd, Jr. | D6/375 |
| D469,968 | S | * | 2/2003 | Van Den Reek | D6/370 |
| 2003/0086761 | A1 | * | 5/2003 | Anderson | 404/6 |

* cited by examiner

*Primary Examiner*—Thomas B. Will
*Assistant Examiner*—Raymond W Addie
(74) *Attorney, Agent, or Firm*—Whitham, Curtis & Christofferson, PC

(57) ABSTRACT

A decorative bench barrier serves the function of providing security for buildings, memorials, and people, while at the same time providing aesthetically pleasing seating suitable for long term use on city streets, in parks, and in other areas. The decorative bench barrier is constructed from one or more reinforced precast concrete elements which include a wide base, a central seating region, and a top back rest. The reinforced precast concrete elements are made in straight sections and radius sections. The radius sections are preferably either 45° or 90°. The sections are interconnectable so that a circular, square, serpentine or other suitable configuration for the bench barrier can be assembled on site.

19 Claims, 4 Drawing Sheets

DECORATIVE BENCH BARRIER

This application claims the benefit of provisional application No. 60/377,262 filed May 1, 2002.

BACKGROUND OF THE INVENTION

1. Field of the Invention

The invention generally relates to a barriers used for security applications such as, for example, in streets and in front of buildings.

2. Description of the Related Art

A wide variety of barrier systems have been used in roadway applications for the purposes of delineating driving lines, blocking off areas, and in other ways focused on the control of traffic. A common barrier system is a curved precast concrete device sometimes referred to as a "Jersey wall". To satisfy current security demands, these same traffic oriented devices are now being used in the front of government buildings, along the edges of sidewalks, and in parks. While these devices are functional for security, they have significant aesthetic drawbacks. In addition, they tend to use a considerable amount of space without providing additional functionality.

SUMMARY OF THE INVENTION

It is an object of this invention to provide a decorative bench barrier that can serve the dual purposes of providing seating for people as well as security to people, buildings, parks, etc.

According to the invention, the bench barrier is manufactured using best practices for precast concrete. The bench barrier will be created from one or more elements, each of which are integrally formed from concrete, and each of which has a base, a back section, and seating portions on either side of the back section. The elements may take a variety of shapes. One preferred shape will have a straight longitudinal axis. Another preferred shape will be in the form of an arc. The arc shaped elements (or "radial" elements) may have a radius of curvature of 5° to 180°, but is most preferably approximately 45° or 90°. A number of arc shaped elements may be joined end-to-end to make a circle which could, for example, accommodate a planter, tree, light post or street sign in a central region. In addition, arc shaped elements may be configured end-to-end in an alternating pattern to create serpentine seating/barrier configuration which may be more aesthetically pleasing in park like settings. Straight sections could provide protected seating along roadways, and may be interconnected with arc shaped sections to create U-shaped and or box shaped designs. The bench barrier elements can be colored or treated with a decorative surface coating to enhance their aesthetic utility. Lifting pockets and/or lifting devices can be integrally formed in the base section of the bench barrier to facilitate transporting and placement of the bench barrier.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1A:
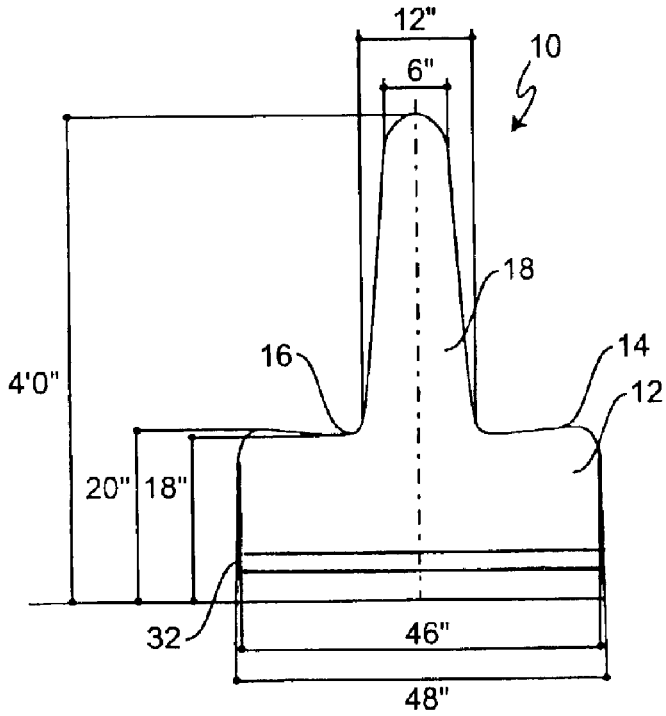
FIG. 1A is a cross-sectional view of a preferred embodiment of a bench barrier element according to the present invention.
Figure 1B:
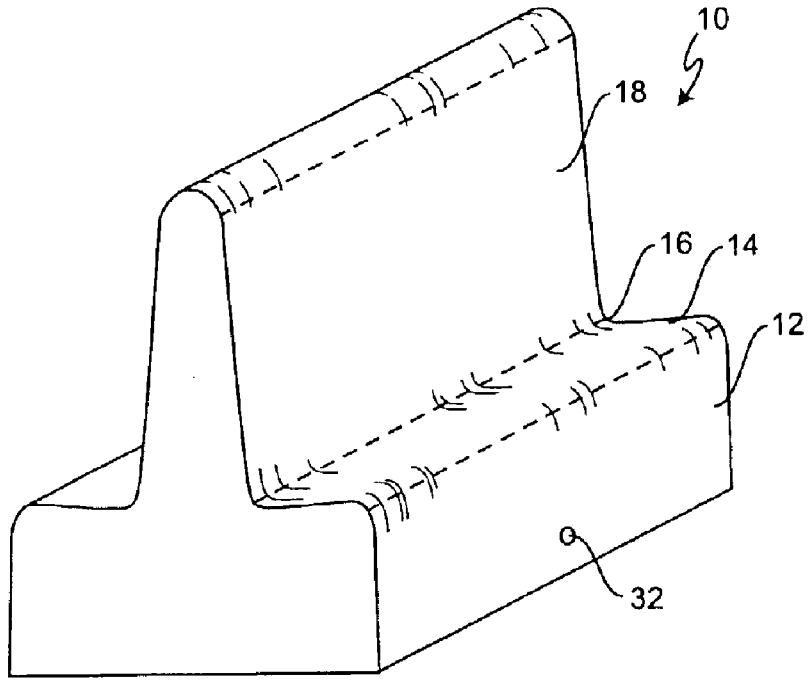
FIG. 1B is an isometric view of a straight bench section having the cross-section shown in FIG. 1A.

Referring now to FIGS. 1A and 1B. there is shown cross-sectional and isometric views, respectively, of a decorative bench barrier 10 according to the invention. The decorative bench barrier 10 includes a base 12, seating sections 14 and 16, and a back section 18. The back section 18 is preferably two sided and is less than 50% of the width of the base 10. Most preferably, the base is approximately four times the width of the back section.

In the preferred embodiment, and for exemplary purposes only, the width of the base will be 48" and will be slightly angled inward towards the vertical height dimension to 46". The back section 18 will be centrally located on top of the base 12, and will have a 12" cross-section at the bottom and incline inward to a 6" cross-section at the top. The height of the decorative bench barrier is 48", and the seat sections 14 and 16 will be located 20" above the ground and will incline downward to 18" as they approach the back section 18. It should be understood that the heights and widths of the bench barrier 10 can vary considerably within the practice of this invention to suit the needs of the manufacturer, the needs or aesthetic desires of the purchaser, and to accommodate the space and features of the environment where the bench barrier 10 will be used.

The bench barrier 10 is designed to be constructed with reinforced concrete, such as, for example, 5000 psi air entrained concrete. Many different mix designs are available. The ultimate goal is to have a bench barrier of a strength suitable to meet the security or other requirements where it will be used. Preferably, the bench barrier 10 is manufactured using best practices in precast concrete. The form (not shown) is positioned upside down for pouring. The form is cleaned and prepped with a form release agent. The reinforcing materials are placed in the form, and secured. Then, the concrete mix is poured into the form, vibrated to achieve more uniform distribution of the concrete throughout the form (e.g., to avoid air pockets), and finished. The casting is allowed to cure before stripping. Preferably the form is constructed so that to enable stripping, the casting is rotated such that it becomes right side up. Care should be taken so that the casting is not damaged during stripping. In addition, the casting should be placed in a protected area until design strength is achieved.

Figure 2A:
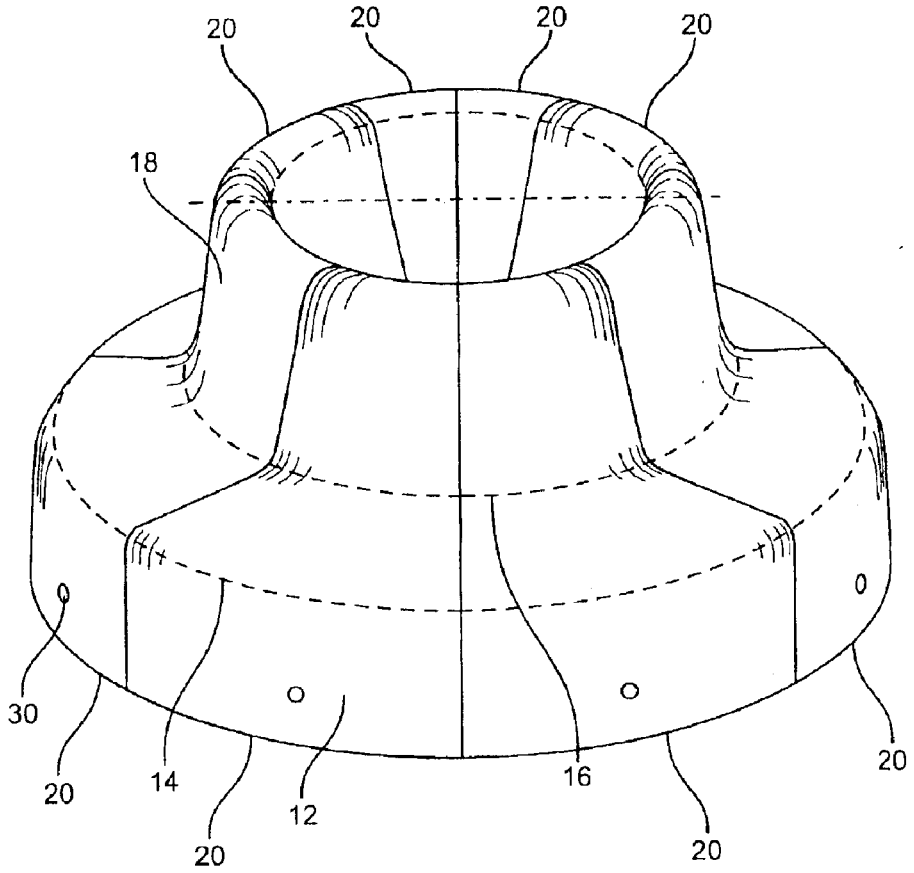
FIG. 2A is an isometric view of one embodiment of a circular bench barrier constructed from curved bench barrier elements having a 45° radius of curvature of the present invention where the bench barrier is configured in a circular pattern.
Figure 2B:
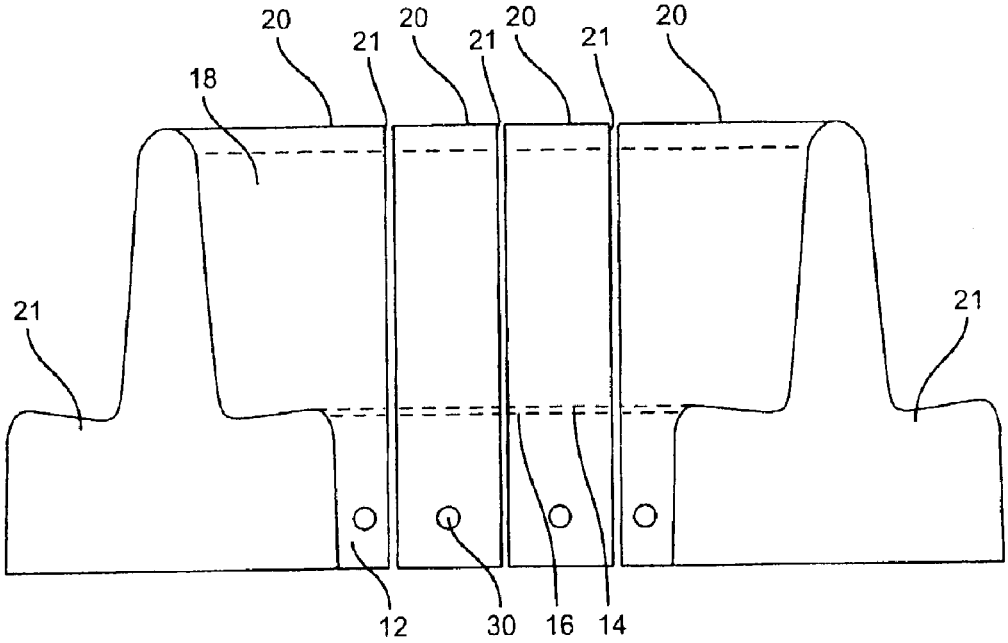
FIG. 2B is a side view of the curved bench barrier elements depicted in FIG. 2A where the curved bench barrier elements are arranged in a semi-circular pattern.
Figure 3A:
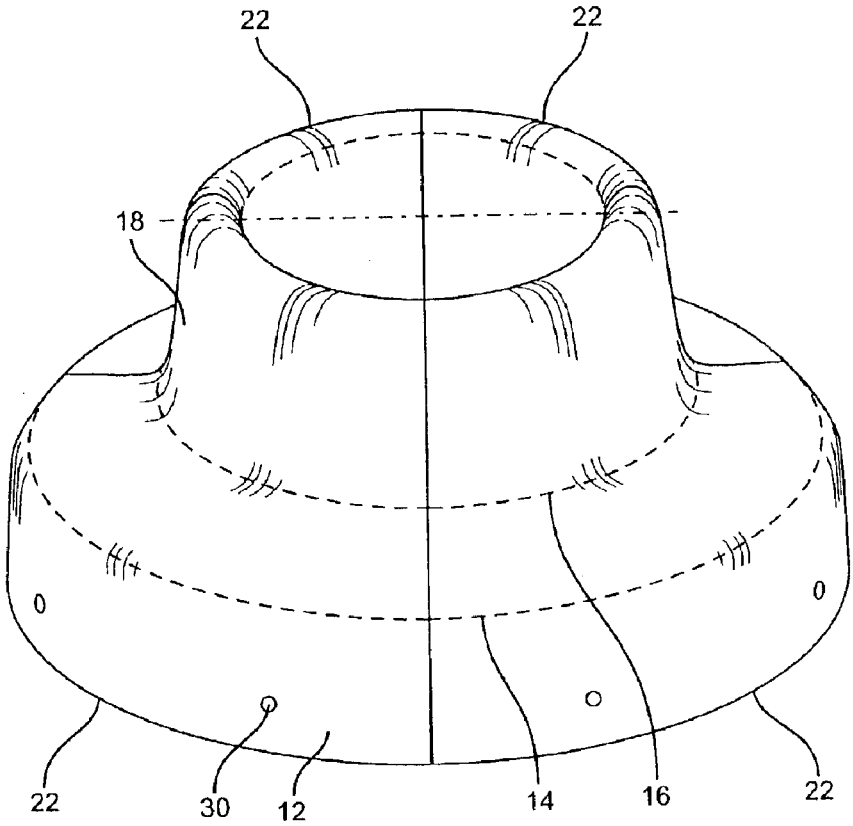
FIG. 3A is an isometric view of an alternative embodiment of the circular bench barrier depicted in FIG. 2A where the bench barrier elements have a 90° radius of curvature.
Figure 3B:
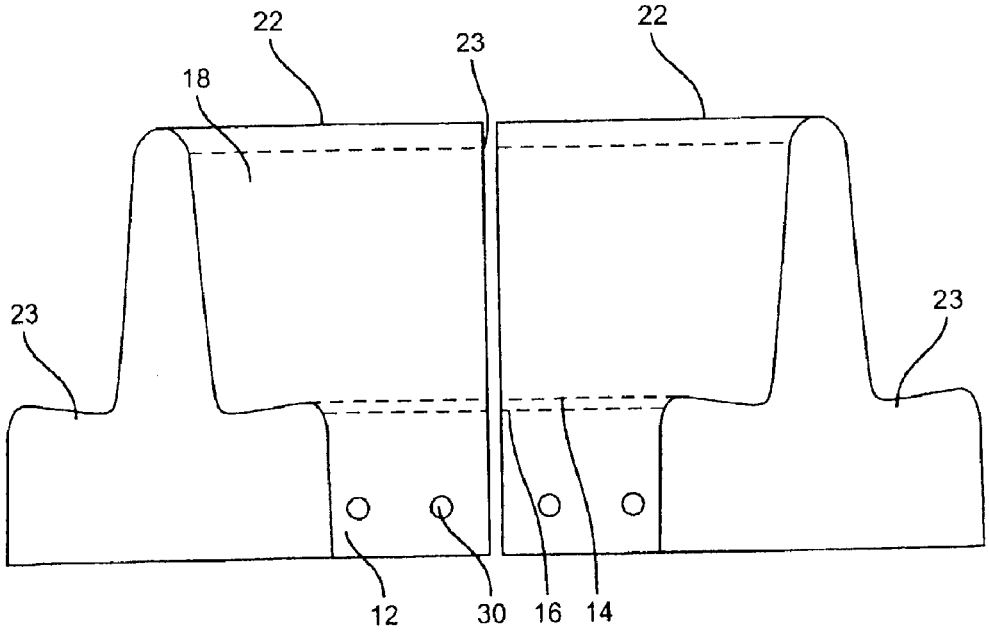
FIG. 3B is a side view of the curved bench barrier elements depicted in FIG. 3A where the curved bench barrier elements are arranged in a semi-circular pattern.

FIGS. 2A, 2B and 3A, 3B show examples of a bench barrier constructed from multiple arc shaped or radial elements 20 or 22. These elements 20 or 22 can be placed end-to-end to make a circular bench which can also serve as a planter for flowers, shrubs or trees in the central region. In FIGS. 2A and 2B, the elements 20 are curved between opposing end faces 21 on a radius of curvature of approximately 45°, while in FIGS. 3A and 3B the radius of curvature between the end faces 23 of each element 22 is approximately 90°. Clearly, any radius of curvature, for example, between 5° and 180° may be employed within the practice of this invention. The 45° elements 20 may provide more flexibility in terms of positioning and configuring the bench barrier, while the 90° elements 22 may provide for a more sturdy construction.

Figure 4:
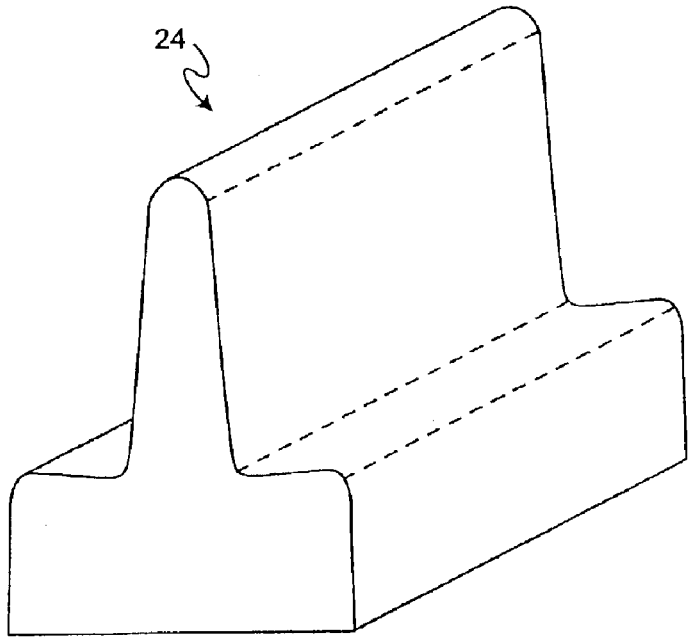
FIG. 4 is an isometric view of a straight bench barrier element of the present invention.

FIG. 4 shows a straight element 24. The element 24 is straight along its longitudinal axis and may be, for example, eight feet in length (however, almost any length (e.g., 2–16 feet) could be practiced according to this invention. A plurality of the straight elements 24 could be linked end-to-end to line a sidewalk at the edge of a street, for example, so as to protect the pedestrians on the side walk, while also providing seating for the pedestrians.

Figure 5:
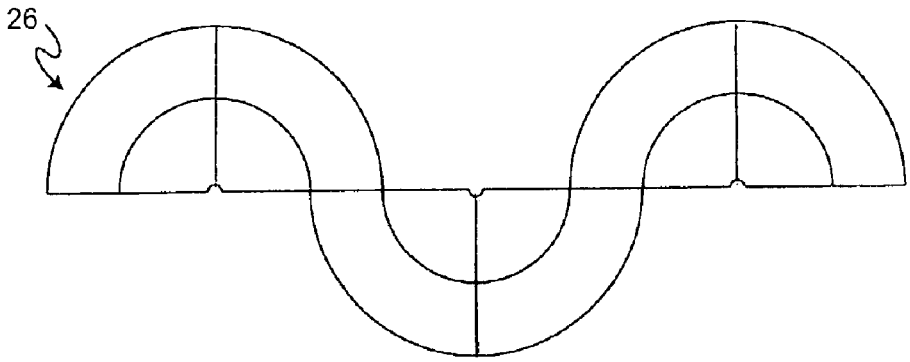
FIG. 5 is a top view of a serpentine bench barrier according to the present invention which is configured from curved bench barrier elements as shown in FIGS. 2A, 2B and/or 3A, 3B.
Figure 6:
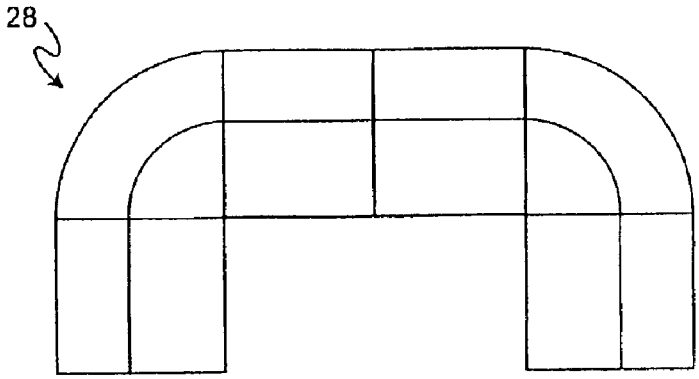
FIG. 6 is a top view of a U shaped bench barrier according to the present invention which is configured from both curved bench barrier elements as shown in FIGS. 2A, 2B and/or 3A, 3B and straight bench barrier elements as shown in FIG. 4.

FIGS. 2A, 2B and 3A, 3B illustrate a circular and a semicircular configuration of the decorative bench barrier. FIG. 5 illustrates a serpentine configuration 26 which is constructed from a plurality of arc shaped elements 20 and/or 22 placed end-to-end in alternating semicircular configurations. FIG. 6 illustrates a U-shaped configuration 28 constructed from a plurality of arc shaped elements 20 and/or 22 and straight elements 24 as shown in FIG. 4. It will be readily apparent that almost any desired configuration decorative bench barrier of this invention could be laid out using the elements of this invention, and will utilize from as few as one element such as one length of straight element 24, to a plurality of elements such as in the serpentine 26, U-shaped configuration 28, circular, and semicircular configurations discussed in detail above.

The elements 20, 22, or 24 can simply be positioned end-to-end adjacent one another, or they can be interlocked end-to-end using, for example, the hook devices described in U.S. Pat. No. 5,149,224, which is herein incorporated by reference. With reference to FIGS. 3 and 5, it can be seen that the bench barrier elements 20 or 22 (but also straight element 24) can include lifting devices 30 cast in a face of the base 12. Typical examples of lifting devices 30 may include the KEY.LOK lifting system available from A.LOK Products, Inc., which includes a polypropylene lift pin insert installed during casting, or other suitable devices. These devices can be used to affix cables for lifting and transporting the bench barrier elements 20, 22, and 24 without damaging there surface finishes (e.g., paint, sprayed gravel, etc.); thereby preserving the aesthetic qualities of the bench barrier. In addition, as shown in FIG. 1A, one or more lifting pockets 32 may be positioned in the base of the bench barrier elements 20, 22 or 24 for lifting and transporting the devices by fork lift.

While the invention has been described in terms of its preferred embodiments, those of skill in the art will recognize that the invention can be practiced with modification within the spirit and scope of the appended claims.

I claim:

1. A decorative bench barrier, comprising:

one or more monolithic elements, each of which includes reinforced concrete;

a base;

a back section positioned on said base, said back section having, a first side and a second side;

first and second seating portions respectively extending from said base to said first and second side of said back; and end portions located at opposite ends of said element, said end portions being in the form of a cross-section of said base, said back section, and said first and second seating portions.

2. The decorative bench barrier of claim 1 wherein said back section has first and second symmetrical sides.

3. The decorative bench barrier of claim 2 wherein said back section is wider at a point which connects with said first and second seating portions than at a top most point of said back section.

4. The decorative bench barrier of claim 1 wherein said base is at least twice as wide as said back section in cross-section.

5. The decorative bench barrier of claim 1 wherein said base is approximately four times as wide as said back section in cross-section.

6. The decorative bench barrier of claim 1 wherein at least one of said one or more elements has a straight longitudinal axis extending between said opposite ends.

7. The decorative bench barrier of claim 1 wherein at least one of said one or more elements has said opposite ends positioned at points on a radius of curvature.

8. The decorative bench barrier of claim 7 wherein said radius of curvature is approximately 90°.

9. The decorative bench barrier of claim 7 wherein said radius of curvature is approximately 45°.

10. The decorative bench barrier of claim 1 further comprising lift pockets formed at a bottom section of said base.

11. The decorative bench barrier of claim 1 further comprising one or more lifting elements formed in a face section of said base.

12. The decorative bench barrier of claim 1 wherein said one or more elements includes at least a plurality of elements each of said plurality having a straight longitudinal axis extending between said opposite ends.

13. The decorative bench barrier of claim 1 wherein said one or more elements includes at least a plurality of elements each of said plurality having opposite ends positioned at points on a radius of curvature.

14. The decorative bench barrier of claim 13 wherein said plurality of elements are arranged in a circular pattern.

15. The decorative bench barrier of claim 13 wherein said plurality of elements are arranged in a semicircular pattern.

16. The decorative bench barrier of claim 13 wherein said plurality of elements are arranged in a serpentine pattern.

17. The decorative bench barrier of claim 1 wherein said one or more elements includes at least a plurality of elements at least a first of said plurality having opposite ends positioned at points on a radius of curvature, and at least a second of said plurality having a straight longitudinal axis extending between said opposite ends.

18. The decorative bench barrier of claim 1 wherein said one or more elements includes at least two elements, and further comprising means for connecting said two elements together.

19. The decorative bench barrier of claim 18 wherein said means for connecting said two elements together is positioned in said end portions of said two elements.

* * * * *